US008042317B2

(12) United States Patent
Doyle

(10) Patent No.: US 8,042,317 B2
(45) Date of Patent: Oct. 25, 2011

(54) DOUBLE AUGER SYSTEM AND METHOD FOR FILLING BAGS WITH SLURRY

(75) Inventor: Stanley B. Doyle, Port Clinton, OH (US)

(73) Assignee: United States Gypsum Company, Chicago, IL (US)

( * ) Notice: Subject to any disclaimer, the term of this patent is extended or adjusted under 35 U.S.C. 154(b) by 0 days.

(21) Appl. No.: 11/603,578

(22) Filed: Nov. 21, 2006

(65) Prior Publication Data

US 2008/0115462 A1 May 22, 2008

(51) Int. Cl.
*B65B 1/32* (2006.01)

(52) U.S. Cl. ..... 53/450; 53/550

(58) Field of Classification Search ..... 53/450, 53/451, 452, 550, 551, 555, 575, 576
See application file for complete search history.

(56) References Cited

U.S. PATENT DOCUMENTS

| | | | | |
|---|---|---|---|---|
| 1,546,360 | A | 7/1925 | Bates | |
| 3,796,021 | A | 3/1974 | Toss | |
| 4,074,507 | A | 2/1978 | Ruf et al. | |
| 4,090,344 | A * | 5/1978 | Kelly | 53/451 |
| 4,407,108 | A * | 10/1983 | Craig | 53/451 |
| 4,436,204 | A | 3/1984 | Sowinski | |
| 4,459,028 | A | 7/1984 | Bruder et al. | |
| 4,516,379 | A | 5/1985 | Iain | |
| 4,671,047 | A | 6/1987 | Mugnai | |
| 4,763,702 | A | 8/1988 | High, Jr. et al. | |
| 4,945,957 | A * | 8/1990 | Kardux et al. | 141/83 |
| 5,115,619 | A | 5/1992 | Lieder | |
| 5,170,609 | A | 12/1992 | Bullock et al. | |
| 5,323,588 | A | 6/1994 | Zak et al. | |
| 5,400,837 | A | 3/1995 | Kelley et al. | |
| 5,413,154 | A | 5/1995 | Hurst, Jr. et al. | |
| 5,606,844 | A | 3/1997 | Takagaki et al. | |
| 5,832,700 | A | 11/1998 | Kammler et al. | |
| 5,870,887 | A | 2/1999 | Bennett | |
| 5,893,260 | A * | 4/1999 | McKenna | 53/451 |
| 5,979,512 | A | 11/1999 | McGregor et al. | |
| 6,112,504 | A | 9/2000 | McGregor et al. | |
| 6,119,438 | A | 9/2000 | Bacon et al. | |
| 6,193,053 | B1 * | 2/2001 | Gaalswyk | 198/662 |
| 6,237,309 | B1 | 5/2001 | DeMarco | |
| 6,314,706 | B1 | 11/2001 | Araki et al. | |
| 6,904,737 | B2 * | 6/2005 | Engesser et al. | 53/451 |
| 7,028,448 | B2 * | 4/2006 | Engesser et al. | 53/451 |
| 2010/0205912 | A1 * | 8/2010 | Winter Von Adlersfluegel | 53/525 |

FOREIGN PATENT DOCUMENTS

DE 19719337 * 12/1998

* cited by examiner

*Primary Examiner* — Hemant M Desai
(74) *Attorney, Agent, or Firm* — Greer, Burns & Crain, Ltd.; Pradip Sahu; Philip T. Petti

(57) ABSTRACT

A slurry product is packaged into a plastic bag using a modified form-fill-seal apparatus and method of using it. The apparatus has preferably been modified to select the appropriate amount of product slurry by weight. Bags are filled using a dual auger system that includes a bulk auger and a precision auger that fill a bag simultaneously. The augers work together for a first period to rapidly load slurry into a large part of the bag. During a second period, the bulk auger shuts down, allowing the precision auger alone to top-off the bags. The periods are determined either by time or by the volume or weight of the product that has entered the bag.

18 Claims, 1 Drawing Sheet

DOUBLE AUGER SYSTEM AND METHOD FOR FILLING BAGS WITH SLURRY

CROSS REFERENCE TO RELATED APPLICATION

This application is being filed concurrently with U.S. Ser. No. 11/603,518, U.S. Patent Application Publication No. 2008/0115467 A1, hereby incorporated by reference.

BACKGROUND

This invention relates to an apparatus and method that forms a flexible bag, fills it with a slurry composition, and seals the bag for shipping. More specifically, it relates to a form-fill-seal apparatus that quickly and accurately fills the bag to an appropriate weight.

In the construction of buildings, one of the most common elements is gypsum wallboard, often known as drywall, used in the construction of walls and/or ceilings. Walls made from gypsum wallboard are conventionally constructed by affixing the panels to studs or joists, and then filling and coating the joints between panels with a specially prepared composition called a joint compound. This process generally proceeds by placing a taping grade joint compound within the joint formed by the abutted edges of the wallboards and embedding a liquid-permeable tape within the taping compound. When dry (or set), a second coating comprising a topping grade joint compound is applied over the joint. This is sanded lightly, then a third coat applied and conventionally finished. Another grade of joint compound is an all-purpose grade that is used both for embedding the tape and for applying the finish coats. A patterned effect may be given to the finished wall and joint with the all-purpose joint compound to provide a textured finish.

There are two general types of joint compound, setting type and drying type. Joint compound of the setting type sets up and becomes firm when hydration reactions convert calcium sulfate hemihydrate and water into an interlocking matrix of calcium sulfate dihydrate crystals. Excess water evaporates. Drying type compound becomes firm upon the loss of water by evaporation.

Each form of joint compound is sold either as a dry powder mix or in the form of an aqueous slurry. The dry powder includes either calcium carbonate or calcined gypsum and dry forms of appropriate additives. Each form has its advantages depending on what is available at the job site. The dry mix requires the transportation of less material. However, it requires the availability of both water and mixing equipment. Where these materials are not readily available, or where the job is so small that it is inconvenient to obtain them, a ready-mix joint compound may be the most suitable form of joint compound to use.

Preparation of a ready-mix, setting type joint compound requires additional chemical components compared to a drying type joint compound or a dry mix. However, once water is added to the calcined gypsum, the setting process begins unless it is prevented chemically. Set retarders are added in sufficient quantities to prevent hardening. Prior to use, a set accelerator is added to the ready-mix joint compound to overcome the effects of the set retarder. If a drying-type joint compound has water added, hardening of the slurry can be delayed if the water is not permitted to evaporate. Keeping a drying-type joint compound tightly sealed is sufficient to keep it in a slurry form.

Slurry products have been a challenge for packaging specialists. The product is very heavy due to the weight of the water. It is fluid within the packaging, allowing the weight distribution to shift. If the packaging is ruptured or punctured, slurries tend to leak out, making a mess of other product in the vicinity. Conventionally, ready-mix joint compounds have been packaged in either a plastic pail or a plastic-lined carton. The hard exterior of these packages provides rupture and puncture protection to the product, it gives support to the heavy slurry and it provides a package that is easier to stack on a palette without shifting.

However, these forms of packaging are very expensive compared to a plastic bag. In addition to the cost of the packaging materials, additional equipment, including carton formers, bag inserters, carton sealers, lid placers, doily placers and lid sealers are needed to complete the packaging. Additional labor is needed to operate and maintain these extra machines. The collective footprint of the packaging equipment is large, requiring a large facility and the accompanying capital investment.

Some prior art filling machines form the bag and transfer most of the product to the bag at one station, then move the bag to a second station to be topped-off accurately. Time and additional equipment are needed to move a partially filled bag of slurry to the second filling station. Movement of the bag provides opportunities for spillage or damage of the bag as well. While topping and sealing the bag at a second fill station may save a bit more time at that the first station, the total time needed to fill the bag including transfer time is not necessarily reduced, and it introduces opportunities for product damage. There will also be a cost associated with additional personnel to operate and maintain the extra equipment.

The prior art reveals little about packaging of slurry compositions. Plastic bags are frequently used for packaging of powdered or granular materials greater than 100 microns in particle size. Joint compound slurry has been packaged in a tube as in U.S. Pat. No. 4,436,204. The joint compound is pumped into the tube. Air is removed from the tube and it is tied or crimped shut. A humectant is sprayed in the inside of the package of ready-mix joint compound to maintain uniform moisture content in U.S. Pat. No. 5,323,588. In U.S. Pat. No. 5,413,154, granular materials are fed by an auger into a gravity fed delivery conduit. A custom product mix is obtainable by programming selected quantities of materials, selected proportions or selected rates. The materials are fed to a transfer line which then moves to a delivery location where the blend is placed in containers. Slurries, such as drilling muds, are optionally made by the addition of a liquid to the granular product.

There is a need in the art for a low-cost packaging alternative to plastic pails and lined cartons for ready-mix gypsum products. There is also a need for a packaging line that accurately measures the product sold by weight. There is yet another need for a packaging system and method that takes up little space and can be operated by a minimum of personnel.

SUMMARY OF THE INVENTION

The above-listed needs are met or exceeded by the improved system and apparatus for packaging a slurry material. The system uses a plastic bag at a considerably less expense compared to a lined carton or a plastic pail.

More specifically, a slurry product is packaged into a plastic bag using a modified form-fill-seal apparatus. The apparatus has preferably been modified to select the appropriate amount of product slurry by weight. Bags are filled using a dual auger system that includes a bulk auger and a precision auger that fill a bag. Either the bulk auger or the augers work together for a first period to rapidly load slurry into a large part of the bag. During a second period, operation of the bulk auger is stopped, allowing the precision auger alone to top-off the bags. The periods are determined either by time or by the volume or weight of the product that has entered the bag.

In another aspect of this invention, a method of packaging a slurry product includes forming a bag, filling the bag using the dual auger system, then sealing the bag. As described above, at least a bulk auger and a precision auger fill the same bag simultaneously for a first period. During a second period, the bulk auger is stopped, allowing the precision auger to complete the filling process.

The method and system of this invention provides fast and accurate filling of bags with slurry. Use of both augers simultaneously speeds filling of the bag. When the bulk auger is stopped, slow filling by the precision auger ensures an accurate amount of slurry is loaded into the bag.

Compared to using conventional packaging, savings are also realized by reducing the amount of equipment needed to package the slurry product. Using a modified form-fill-seal machine, the single machine is all that is needed to form a plastic bag, fill it with slurry, seal the bag and prepare it for shipping. There is no need for carton forming equipment, tiers, bag inserters, carton sealers, lid placers, doily placers or lid sealers. The packaging operation is completed in a much smaller amount of space, allowing part of the plant to be used for other purposes or requiring a lower capital expenditure.

Fewer people are needed to operate and maintain the packaging equipment because there is less of it. Although the process is automated, workers are still needed to clear jams, perform routine maintenance and supply the machines with raw materials. When there are fewer machines to be serviced, fewer operators and maintenance people are needed.

Yet another advantage of the present invention is the forming, filling and sealing of the bag without moving the bag to another station, reducing the opportunity for spillage or damage to partially filled bags of product.

DETAILED DESCRIPTION OF THE INVENTION

Figure 1:
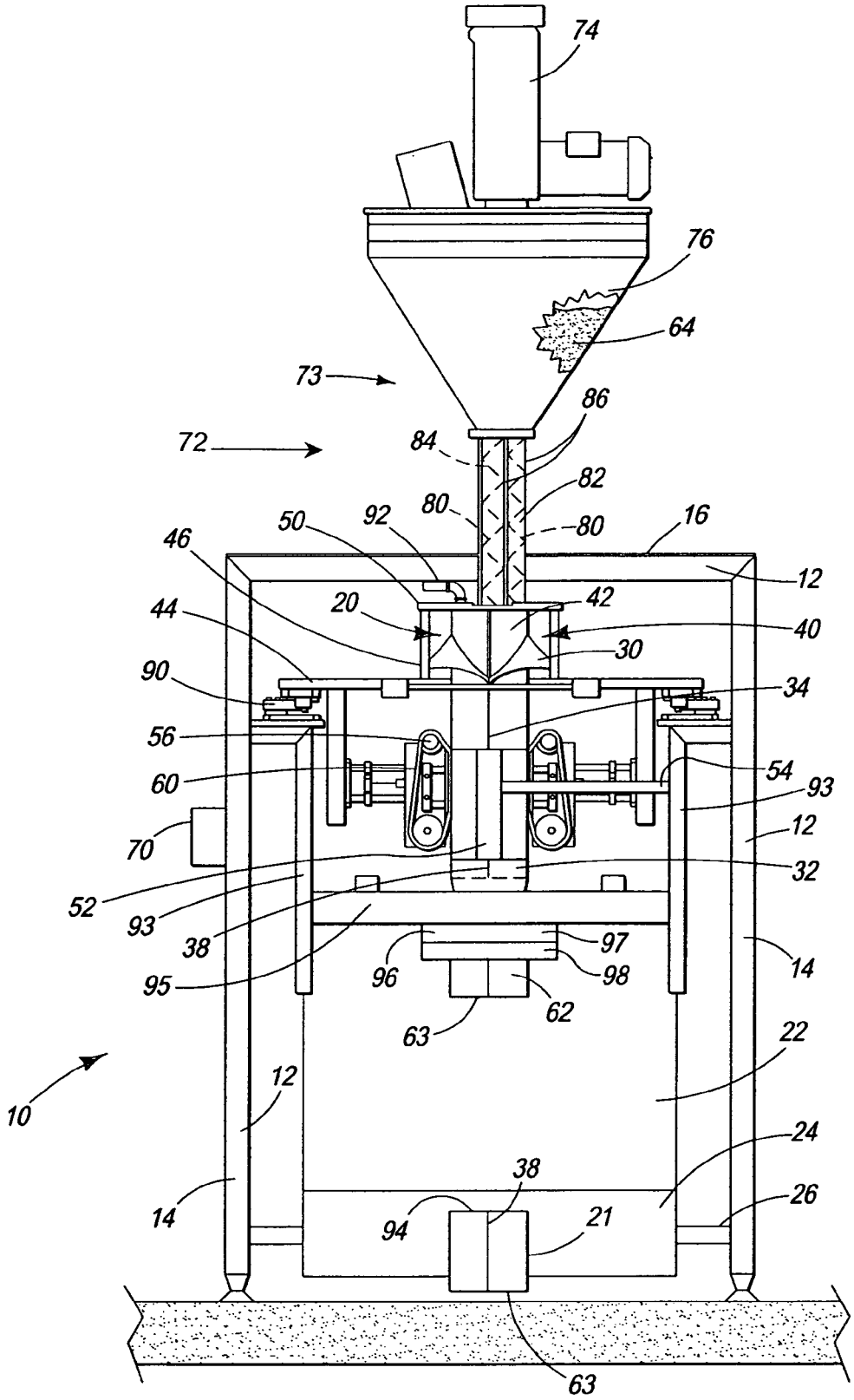
FIG. 1 is a front plan view of a form-fill-seal packaging machine.

Directional references described herein refer to the form-fill-seal machine, generally 10 and its components as oriented in FIG. 1. A form-fill-seal machine 10 includes a bag former, a bag filler and a bag sealer. A bag is produced by this machine that is filled with a slurry, such as a gypsum-based ready-mix joint compound.

An apparatus that exemplifies one embodiment is obtainable by modifying a conventional Form/Fill & Seal Machine. A Matrix Pro Max 2024 P Form/Fill & Seal Machine ("2024 Machine") by Matrix Packaging Machinery (Saukville, Wis.) can be modified to obtain at least one embodiment of this invention. One skilled in the art of designing similar machines would also be able to design and build a form/fill/seal machine having the features described herein.

Referring to FIG. 1, a form-fill-seal packaging machine, generally 10, is supported by a primary frame 12 that supports several components of the machine, holding them at a convenient height during use. The material from which the primary frame 12 is made is unimportant, as long as it is sufficiently sturdy to support all components of the packaging machine. Preferably, the primary frame 12 is metal, such as steel, particularly stainless steel. A plurality of vertical supports 14 are part of the primary frame 12, to which other components of the packaging machine are attached. The vertical supports need not be exactly vertical, but are sufficiently vertical to space the machine components into a workable arrangement. The uppermost horizontal portion of the primary frame 12 is a table 16.

The bag former assembly, generally 20, forms a bag 21 from plastic film sheeting 22 from a roll 24. The roll 24 of flexible, sealable plastic film 22 suitable for use in packaging is mounted to the primary frame 12, preferably on an axle 26 that allows it to rotate and freely feed the film 22 to a mandrel 30. One or more pinch rolls (not shown) are used to take up slack as the film 22 comes off the roll 24 and to feed the plastic to an exact length by sensing pre-printed eye-spots. The pinch rolls also provide an appropriate tension for the bag forming process.

The bags 21 are made using any flexible, sealable plastic film 22. Preferred films 22 include polyethylene, polyester and co-extruded nylon, however, any plastic film usable in a form-fill-seal machine can be used. Multi-layer films, such as those having both nylon and polyethylene plies, are particularly useful for large bags 21 where additional strength is needed to carry the weight. Thickness of the film varies from 0.004" to about 0.008". Preferably, the film sheeting 22 is sized so that the film is sufficiently wide to form the circumference of a tube 32 from which the bag 21 is formed, with an allowance for edges 34 to form a seam 38 to close the tube.

A forming tube assembly, generally 40, shapes the film 22 into the bag 21. The forming tube assembly 40 includes the mandrel 30, a forming tube 42, and at least one mounting plate 44. This assembly determines the size of the bag 21 to be made. If the bag 21 of a different size is required, it is necessary to change the size of the forming tube 42. Use of a quick release connector (not shown) is preferred so that the forming tube 42 is easily removed for replacement by a forming tube assembly of another size to produce a different size bag 21.

The mounting plate 44 is attached to the upper mounting plate 50 by one or more of the forming tube supports 46 at a point uncovered with the plastic film 22 when the machine is in use. This arrangement allows the forming tube 42 and mandrel 30 to be suspended from the upper mounting plate 50. The forming tube 42 is preferably bolted to the upper mounting plate 50. Loosening of the bolts (not shown) allows changing of the forming tube 42 if necessary to make bags 21 of a different size. One preferred forming tube 42 is a rectangle with semicircular ends. Flat plastic film 22 comes from the roll 24 and pinch rollers and is drawn over the mandrel 30, which guides the film as it wraps around the forming tube 42 to form a tube 32. Once the film 22 is wrapped around the forming tube 42, both the forming tube and film pass through an opening in the mounting plate 44.

Preferably the dimensions of the forming tube 42 varies as needed to make a bag 21 of appropriate size. The forming tube 42 often has a rectangular or circular cross section, although the use of other shapes is contemplated. One preferred forming tube 42 is a rectangle with semicircular ends. The forming tube 11½ inches (29.2 cm) wide and about 3 inches (7.6 cm) deep was satisfactory to make 30 pound (13.6 Kg) bags of joint compound slurry 64. The shape of the forming tube 42 is not important, as long as it is sized to create an acceptable size bag 21. It is anticipated that the size of the forming tube can be varied 2-3 inches (5-7 cm) in each dimension without ill effects. Preferably, the forming tribe 42 varies from about 10 inches (10 cm) to about 15 inches (38 cm) in width.

Next, the edges of the film 22 are brought together and the edge seal 38 is formed with a first sealer 52 to form the substantially continuous tube 32. The edge seal 38 extends along the length of the continuous tube 32 in a direction that is parallel to the longitudinal axis of the forming tube 42. On the finished bag 21, the edge seal 38 runs along the side or back of the bag from top to bottom. The first sealer 52 is often in a vertical position and uses heat to bonds the edges of the film 22 together. A preferred first sealing device 52 is a stream of hot air aimed at the edges 34 of the film, bonding them together. Any type of sealing device, including an impulse sealer or a resistance sealer, could also be used as the first sealer 52. An artisan in the packaging industry will readily recognize that other types of seals, including lap seals and pinch seals are usable in this type of equipment with a suitable choice of forming units.

For ease in changing the forming tube assembly, the first sealing device is mounted to the frame by a swinging arm 54 attached to part of the primary frame 12 or an inner frame 93. The swinging arm 54 moves the first sealing device 52 away from the forming tube 42. This action provides space around the forming tube 42 when the forming tube assembly 40 is changed to a different size to make bags 21 of various sizes. When the new forming tube assembly 40 is in place, the swinging arm 54 is returned to its position with the first sealing device 52 adjacent the forming tube 42.

Optionally, movement of the plastic film 22 along the length of the exterior of the forming tube 42 is assisted by one or more bag movers 56. Examples of the bag movers 56 include a motorized feed belt 60, tread or wheel (not shown) that are positioned against the film 22 so that friction from the bag mover 56 pushes the film downwardly along the forming tube 42. An attached bag 62 is the portion of the plastic film 22 at the bottom of the forming tube 42 having a bottom seam 63 so that it is capable of accepting a slurry product 64. Preferably, the feed belts 60 change speed, start or stop, depending on the speed at which the attached bag 62 is being filled with slurry 66. While filling of the attached bag 62 is occurring, the feed belts 60 move the continuous tube 32 slowly, if at all. While the filled attached bag 62 is being sealed and cut, the feed belts 60 are stopped. The feed belts 60 move the continuous tube 32 quickly after a filled bag 21 falls away and the attached bag 62 starts to fill. When the attached bag 62 is being topped-off, the fill rate, and thus the rate of movement of the bag, slows. Preferably there are at least two bag movers 56 positioned on opposing sides of the forming tube 42.

The bag mover 56 is operated by a computerized controller 70 that coordinates the operation of the moving parts so that high-speed operation is obtainable. For example, the controller 70 determines the fill rate, the movement of the plastic film 22 and the operation of the one or more sealers. Preferably, the controller 70 is a digital device, such as a microcomputer. However, the use of one or more analog control devices is also contemplated. An especially preferred controller 70 is any one designed for use with Form/Fill & Seal equipment, such as those made by Rockwell Automation Allen-Bradley & Rockwell Software Brands of Milwaukee, Wis. The use of controllers 70 for automation of Form/Fill & Seal processes is well known to those in the art.

The bag filling assembly 72 includes the equipment to dispense the slurry 64 into the bags 21. A volumetric filler 74 dispenses slurry 64 in discrete batches to the hopper or feed tank 76. The hopper 76 continuously feeds the slurry 64 and is preferably in an elevated location so that gravity assists with flow of the slurry. The preferred slurry 64 is a ready-mix joint compound of either the setting type or the drying type. Setting-type joint compound is based on calcium sulfate hemihydrate that is converted to calcium sulfate dihydrate upon the addition of water. A preferred product for use with this invention is SHEETROCK® Brand Lightweight Setting-Type Joint Compounds (USG Corp., Chicago, Ill.). Calcium carbonate is the primary component of drying-type joint compound. Both are sold in a ready-mix form and are suitable for use with this invention. Other materials, such as drilling mud, that are sold as a slurry or paste are also suitable for packaging in this manner.

Slurry 64 is transported from the hopper 76 to the bag 21 by one or more feed augers 80 positioned within the forming tube 42. A drive (not shown) that is regulated by the controller 70 turns the feed auger 80 to deliver the slurry at appropriate rates during the filling cycle.

In a preferred embodiment, the feed auger 80 is made up of at least two feed augers, a precision auger 82 and a bulk auger 84. The bulk auger 84 is preferably large and moves large amounts of joint compound 64 quickly. During rapid filling of the bag 21, it is also contemplated that both the precision auger 82 and the bulk auger 84 be used simultaneously to increase the rate of slurry 64 transfer. Fine adjustments in the final slurry 64 weight are made by the precision auger 82 alone. Slow filling of the bag by the precision auger 82 is accomplished by using an auger having a smaller diameter, turning it much more slowly than the bulk auger 84 or both. Where two augers 80 are used, both are operated by the controller 70. Preferred auger fillers are Mateer-Burt 1990 HD Auger Fillers with an electric clutch motor (Wayne, Pa.).

Optimum auger size depends on the size of the bag 21 and the speed with which it is to be filled. The feed augers 80 are sized to fit within the forming tube 42 and to fill the bag 21 in a reasonable amount of time. For a 30-pound bag of joint compound, preferably the bulk auger 84 is approximately 2.5 inches (6 cm) to about 3.5 inches (9 cm) in diameter and dispenses joint compound 64 at the rate of 50 gal/min. An especially preferred bulk auger 84 is about 3 inches (7.5 cm) in diameter and is made by Mateer-Burt. In contrast, the precision auger 82 is about 0.8 inch (2 cm) in diameter to about 1.2 inches (3 cm) in diameter, moving joint compound 64 at the rate of 10 gal/min. The preferred precision auger 82 is 1 inch (2.5 cm) in diameter and is made by Mateer-Burt. Variation in auger diameter of at least 20% is contemplated. If a single auger is used, the preferred auger is a #52, 4 inch diameter auger (Mateer-Burt-, Wayne, Pa.). Preferred feed augers 80 for this application were four feet in length (122 cm). These dimensions are variable as the size of the bag 21 changes. In this case, the bag 21 produced was 3 inches (7.6 cm) by 12 inches (30 cm) by 24 inches (61 cm).

Each auger 80 is optionally fit inside an auger tube 86 having an inside diameter that is only slightly larger than the outside diameter of the feed auger. This tube 86 keeps the slurry moving toward the bag without allowing it to become coated on the inside of the forming tube 42. Use of an auger tube 86 also allows the top of the forming tube 42 to be sealed by the upper mounting plate 50. Sealing of the forming tube 42 is preferably to apply a vacuum to the filled attached bag 62, withdrawing unwanted air prior to sealing of the attached bag.

A vacuum tube 92 runs from inside the forming tube 42 to a vacuum pump (not shown) for this purpose. Preferably, air is removed from the attached bag 62 prior to sealing the bag. A preferred vacuum pump is the Industrial Dust Collector by Beckert and Heister, Inc. of Saginaw, Mich. There are holes (not shown) in the mounting plate to allow the augers 80 inside the auger tubes 86 to pass from the hopper 76 through the mounting plate 44 to the top of the forming tube 42. The holes should be configured to fit the auger tubes 86 snugly, including a seal between the auger tube and the mounting plate 44 if necessary. When the vacuum pump is activated, air from the inside of the attached bag 62 and the forming tube 42 is drawn toward the pump. The attached bag 62 is then sealed prior to deactivation of the vacuum pump. Removal of excess air from the attached bag 62 allows it to lay flat when stacked for shipping or on a store shelf.

Slurry 64 from the volumetric filler 74 is deposited periodically into the hopper 76. When the controller 70 calls for the slurry 64 to be put into the attached bag 62, motion of the bulk auger 84 and/or the precision auger 82 causes slurry to be drawn from the hopper 76 down the length of the forming tube 42. During a first period, when movement of a new charge of slurry 64 begins, it is advantageous to move large amounts of product very quickly. At this time, both the bulk auger 84 and the precision auger 82 are moving together to fill the attached bag 62 quickly. However, as the weight of product inside the attached bag 62 approaches the final target weight, the bulk auger 84 stops and a second period begins. During the second period, the precision auger 82 alone continues to supply slurry 64 to the attached bag 62. Since the precision auger 82 is smaller than the bulk auger 84, the rate of slurry 64 being added to the attached bag 62 decreases, making it easier to control the final weight dispensed. The second period ends when the attached bag 62 is substantially filled to the target weight stated on the bag with the slurry 64.

The bulk auger 84 and the precision auger 82 are positioned to allow both of them to feed slurry 64 simultaneously to the attached bag 62. Both of the augers 80 are supported from a drive mechanism above the hopper 76. They descend through the hopper 76 and the forming tube 42. As the augers 80 rotate, slurry 64 is trapped by the turns of the augers, pushing the slurry from the hopper 76, and down the length of the forming tube 42. At the end of the auger 80, the slurry 64 is pushed from the auger by the slurry behind it, allowing it to fall by gravity into the attached bag 62. Preferably the two augers 82, 84 oppose each other, feeding from two sides of the attached bag 62.

The first period is defined as the time from the start of movement of joint compound slurry 64 into the attached bag 62 until the bulk auger 84 stops. This period is definable in many ways. Time is one useful way to determine the end of the first period. When the apparatus is operating consistently, after a given time approximately the same amount of joint compound slurry 64 will have been loaded into the attached bag 62. Another way of defining the end of the first period is by measuring the amount, either by weight or volume, of the slurry 64 that has been dispensed to the attached bag 62.

Preferably, the end of the first period is determined when at least 75% of the final target weight of joint compound slurry 64 is present in the attached bag 62. More preferably, at least 80% to about 95% of the joint compound slurry 64 should be present in the attached bag 62 to define the first period. When the end of the first period arrives, the bulk auger 84 stops and the precision auger 82 continues delivery of the joint compound 64 during the second period. The end of the second period is defined by either time, weight of joint compound 64 or volume of joint compound when the attached bag 62 is full. Delivery of the joint compound 64 ceases at that time.

It is also preferred that filling of the attached bag 62 is monitored by the controller 70 by the weight of the slurry 64 in the bag. Load cells 90 are positioned to detect the changes in weight of the attached bag 62 as the slurry 64 detaches from the end of the feed augers 80 and falls into the bag. The slurry 64 weight is measurable either as it is lost from the feed augers 80 or as it is gained by the attached bag 62. The load cells 90 are positionable anywhere where 1) they bear the weight of exactly one of the feed augers 80 or the attached bag 62; and 2) the slurry is the only part of the weight on the load cells 90 that is changing.

Formation of the bags can be interrupted when the film roll 24 is changed or when the forming tube 42 is changed. When the film 22 approaches the end of the roll 24, the film is cut or allowed to be used up. The machine 10 is shut down and the newly charged film 22 is connected to the preceding film using a splicer (not shown). If necessary, the controller 70 causes the bag mover 56 to advance the film 22 to the end of the roll 24 so that the forming tube assembly 40 is cleared of plastic film. After the film 22 flow has stopped, the roll 24 or the forming tube assembly 40 is replaced. Delivery of the slurry 64 ceases during that time. The packaging machine 10 also optionally includes a printing device for printing information, such as the manufacturing date or the lot number, on the film 22. After the bag 21 has been separated from the film 22 and machine 10, it is usually moved on a conveyor to be packaged and/or shipped to users.

Referring to FIG. 1, the load cells 90 are positioned between an inner frame 93 and the primary frame 12. In this position, the load cells 90 bear the weight of at least the forming tube assembly 40, the plastic film 22 on the forming tube 42 or the mandrel 30, and the weight of the slurry 64 in the attached bag 62. The weight of the slurry 64 in the hopper 76 and on the augers 80 is borne by the support for the volumetric filler 74 and not by the load cells.

At the beginning of the first period, the controller 70 reads the weight on the load cells 90 then computes and records the weight thereon. Since a new attached bag 62 has just moved into position, the recorded weight should be the weight of the equipment on the load cells, which does not change. The controller 70 causes the drivers of the feed augers 80 to begin feeding slurry 64 to the attached bag 62. Monitoring of the weight of the attached bag 62 is regulated by the controller 70, preferably continuously, but monitoring at discrete intervals is also contemplated. An appropriate time interval will depend upon the size bag utilized and the speed with which the form/fill/seal machine advances the film 22 and fills the attached bag 62. Intervals of up to about 3 seconds between load cell readings are useful for most applications.

When the controller 70 computes the weight of slurry 64 added to the attached bag 62 to be about 75% to 80% of the final target weight, the controller initiates the second period by causing the bulk auger 84 to stop feeding slurry 64. The precision auger 82 continues feeding slurry 64 while the controller 70 monitors the load cell weight. When the controller 70 computes that the full target weight of slurry 64 has been added to the attached bag 62, the controller causes all slurry 64 feed to stop, activates the vacuum system to draw air from the attached bag 62 and causes the horizontal top seam 94 of the attached bag 62 to be effected by the second sealer 96.

The second sealer 96 seals the cylinder of film 22 to simultaneously form the top seam 94 of the attached bag 62 and the bottom seam 63 of the next bag 21. Preferably the seam 63 created by the second sealer 96 is oriented in a transverse direction to the axis of the forming tube 42. In many embodiments, the second sealer 96 includes a cutter (not shown) to separate the sealed attached bag from the remainder of the film 22. Any sealing method suitable for a plastic bag is usable, but impulse and resistance sealers are preferred. In some embodiments, the second sealer 96 includes two separate sealers. A top second sealer 97 seals the bottom of an attached bag 62 adjacent to the attached bag that was just filled. A bottom second sealer seals the top of the filled attached bag. The second sealer 96 is optionally positioned at the outlet of the forming tube 42. In the embodiment of FIG. 1, the second sealer is mounted to a cross brace 95.

In use, a product composition is prepared for packaging. The preferred product is a joint compound slurry, however, the use of this process for packaging of a dry powder, such as a joint compound mix, is also contemplated. The bag is formed to receive the product. When a form/fill/seal machine is used, the plastic film is shaped over the mandrel, then is wrapped around the forming tube. As the film is moved by the bag mover, a continuous edge seam is formed to make a continuous plastic film tube. The bottom seal of an attached bag is made when the top of the previous bag is sealed. After the previous bag has been separated from the plastic film, the attached bag is moved into position by a controller to be filled.

Filling the attached bag with the product composition uses at least a bulk auger and a precision auger. Both augers are managed by the controller, which also monitors the weight of product being deposited into the attached bag using load cells. At least the bulk auger, and preferably both augers, turn to deposit the product composition within the attached bag during a first period. The precision auger only feeds slurry to the bag for a second period. When the target weight has been reached, the controller moves the attached bag into position and seals the bag. Filling of the bag is completed at this single station or position, without moving of the bag to a different station for topping off or weighing.

While a particular embodiment of the dual auger system for filling a bag has been shown and described, it will be appreciated by those skilled in the art that changes and modifications may be made thereto without departing from the invention in its broader aspects and as set forth in the following claims.

What is claimed is:

1. A method for bagging a joint compound slurry composition, comprising:

forming a bag;

filling the bag with the joint compound slurry composition using at least a bulk auger and a precision auger, the bulk auger and the precision auger each being positioned in a separate auger tube and simultaneously within the bag, wherein one of the bulk auger alone and the bulk auger and precision auger together feed the joint compound slurry composition to the bag for a first period and the precision auger only feeds the joint compound slurry composition to the bag for a second period;

disposing the auger tubes including the bulk auger and the precision auger adjacent to each other so that the joint compound slurry composition is fed relatively rapidly into the bag simultaneously from opposite sides of the bag; and sealing the bag.

2. The method of claim 1 wherein said filling step further comprises turning both the precision auger and the bulk auger simultaneously and the precision auger turns at a rate slower than the bulk auger.

3. The method of claim 1 further comprising monitoring contents of the bag by weight.

4. The method of claim 3 further comprising terminating the first period when the bag has been filled to at least 75% of a target product weight stated on the bag.

5. The method of claim 4 further comprising terminating the second period when the bag has been filled to approximately 100% of the stated weight.

6. The method of claim 1 further comprising filling the bag in a single position.

7. An apparatus for bagging joint compound slurry composition comprising:

a frame;

a bag former on said frame configured to form a bag;

a bag filler mounted to said frame for filling the bag formed by said bag former, comprising at least a bulk auger and a precision auger positioned within the bag, wherein one of said bulk auger alone and said bulk auger and said precision auger together being configured to simultaneously feed the joint compound slurry composition to the bag on said bag former for a first period and said precision auger configured to feed the joint compound slurry composition to the bag for a second period;

a mounting plate connected to said frame and positioned between said bag former and said bag filler, said mounting plate forming a seal with said bag former;

a vacuum source in fluid communication with said bag former for removing air from the bag after forming and filling;

a pair of adjacent auger tubes each enclosing one of said bulk auger and said precision auger for sealing said augers against ambient, and said vacuum source being in fluid communication with said auger tubes for withdrawing air from the bag prior to sealing; and a bag sealer.

8. The apparatus of claim 7 further comprising a controller configured to coordinate operation of said bag former, said bulk auger, said precision auger and said bag sealer.

9. The apparatus of claim 7 wherein the bulk auger is from about 2.5 inches to about 3.5 inches in diameter.

10. The apparatus of claim 7 wherein said precision auger is from about 0.8 inches to about 1.2 inches in diameter.

11. The apparatus of claim 7 wherein said bag former comprises a forming tube assembly.

12. The apparatus of claim 11 wherein said forming tube assembly further comprises a forming tube and a mandrel.

13. The apparatus of claim 7 further comprising a plurality of load cells configured to monitor filling of the bag by weight.

14. The apparatus of claim 7 wherein said frame further comprises an mounting plate and said upper mounting plate is attached to said upper mounting plate by forming tube supports.

15. The apparatus of claim 7 wherein said frame further comprises a swingable arm mounted to said frame that supports at least one component of the sealer.

16. The apparatus of claim 7 wherein the bag is filled in a single position.

17. The apparatus of claim 7 wherein said bag former includes a forming tube about which a web of film is positioned to form the bag and further includes at least one motorized bag mover disposed in close relationship to said forming tube for moving the film along said tube towards a lower tube end.

18. An apparatus for bagging a joint compound slurry composition, comprising:

a frame;

a bag former on said frame configured to form a bag, said bag configured to remain stationary relative to said frame;

a bag filler mounted to said frame above said bag former, comprising at least a bulk auger and a precision auger positioned within the bag, each said auger being disposed in a separate corresponding auger tube for facilitating movement of the joint compound slurry composition, said tubes being adjacent to each other to fill the bag from opposite sides of the bag;

a controller for operating said bulk auger and said precision auger simultaneously during a first period of bag filling, and for operating only said precision auger during a second period of bag filling; and at least one bag sealer.

* * * * *